US005535914A

United States Patent [19]

Badalamenti et al.

[11] Patent Number: 5,535,914

[45] Date of Patent: Jul. 16, 1996

[54] GROCERY BAG HOLDING CONTAINER

[76] Inventors: Frank Badalamenti; Patricia Badalamenti, both of 42 Cheseborugh St., Staten Island, N.Y. 10312

[21] Appl. No.: 417,195

[22] Filed: Apr. 5, 1995

[51] Int. Cl.[6] ..... B65D 43/08; B65D 90/04

[52] U.S. Cl. ..... 220/404; 220/352; 220/770; 220/771

[58] Field of Search ..... 220/404, 355, 220/908, 770, 772, 771, 352

[56] References Cited

U.S. PATENT DOCUMENTS

| | | | |
|---|---|---|---|
| 1,286,368 | 12/1918 | Lucas | 220/908 X |
| 3,491,913 | 1/1970 | Giraudet et al. | 220/770 X |
| 4,535,911 | 8/1985 | Goulter | 220/404 |
| 4,576,310 | 3/1986 | Isgar et al. | 220/404 |
| 4,664,347 | 5/1987 | Brown et al. | 220/404 X |
| 4,856,675 | 8/1989 | Palazzola | 220/404 |
| 4,867,339 | 9/1989 | Hahn | 220/404 |
| 4,921,196 | 5/1990 | Rudko | 220/404 X |
| 5,050,762 | 9/1991 | Giorgi | 220/908 X |
| 5,054,724 | 10/1991 | Hutcheson | 220/404 X |

FOREIGN PATENT DOCUMENTS

| | | | |
|---|---|---|---|
| 6171668 | 6/1994 | Japan | 220/404 |
| 6156605 | 6/1994 | Japan | 220/404 |

*Primary Examiner*—Allan N. Shoap
*Assistant Examiner*—Niki M. Kopsidas

[57] ABSTRACT

A container for receiving and supporting a grocery bag. The inventive device includes a container having engaging assemblies extending from laterally opposed sides thereof for engaging the handle loops of a grocery bag. A lid positionable across an open upper end of the container has laterally opposed cut-outs permitting projection of the engaging assemblies of the container through the lid.

2 Claims, 3 Drawing Sheets

GROCERY BAG HOLDING CONTAINER

BACKGROUND OF THE INVENTION

1. Field of the Invention

The present invention relates to lined container structures and more particularly pertains to a grocery bag holding container for receiving and supporting a handled grocery bag.

2. Description of the Prior Art

The use of lined container structures is known in the prior art. More specifically, lined container structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art lined container structures include U.S. Pat. No. 4,623,111; U.S. Pat. No. 4,925,056; U.S. Pat. No. 4,930,734; U.S. Pat. No. 5,105,969; and U.S. Design Patent 302,062.

While these devices fulfill their respective, particular objectives and requirements, the aforementioned patents do not disclose a grocery bag holding container for receiving and supporting a handled grocery bag which includes a container having engaging assemblies extending from laterally opposed sides thereof for engaging the handle loops of the grocery bag, and a lid positionable over an open upper end of the container which includes lateral cut-outs permitting projection of the engaging assemblies therethrough.

In these respects, the grocery bag holding container according to the present invention substantially departs from the conventional concepts and designs of the prior art, and in so doing provides an apparatus primarily developed for the purpose of receiving and supporting a grocery bag.

SUMMARY OF THE INVENTION

In view of the foregoing disadvantages inherent in the known types of lined container structures now present in the prior art, the present invention provides a new grocery bag holding container construction wherein the same can be utilized for receiving and supporting a handled grocery bag. As such, the general purpose of the present invention, which will be described subsequently in greater detail, is to provide a new grocery bag holding container apparatus and method which has many of the advantages of the lined container structures mentioned heretofore and many novel features that result in a grocery bag holding container which is not anticipated, rendered obvious, suggested, or even implied by any of the prior art lined container structures, either alone or in any combination thereof.

To attain this, the present invention generally comprises a container for receiving and supporting a grocery bag. The inventive device includes a container having engaging assemblies extending from laterally opposed sides thereof for engaging the handle loops of a grocery bag. A lid positionable over an open upper end of the container includes lateral cut-outs permitting projection the engaging assemblies therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new grocery bag holding container apparatus and method which has many of the advantages of the lined container structures mentioned heretofore and many novel features that result in a grocery bag holding container which is not anticipated, rendered obvious, suggested, or even implied by any of the prior art lined container structures, either alone or in any combination thereof.

It is another object of the present invention to provide a new grocery bag holding container which may be easily and efficiently manufactured and marketed.

It is a further object of the present invention to provide a new grocery bag holding container which is of a durable and reliable construction.

An even further object of the present invention is to provide a new grocery bag holding container which is susceptible of a low cost of manufacture with regard to both materials and labor, and which accordingly is then susceptible of low prices of sale to the consuming public, thereby making such grocery bag holding containers economically available to the buying public.

Still yet another object of the present invention is to provide a new grocery bag holding container which provides in the apparatuses and methods of the prior art some of the advantages thereof, while simultaneously overcoming some of the disadvantages normally associated therewith.

Still another object of the present invention is to provide a new grocery bag holding container for receiving and supporting a grocery bag.

Yet another object of the present invention is to provide a new grocery bag holding container which includes a container having engaging assemblies extending from laterally opposed sides thereof for engaging the handle loops of the grocery bag, and a lid positionable over an open upper end of the container which includes lateral cut-outs permitting projection of the engaging assemblies therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
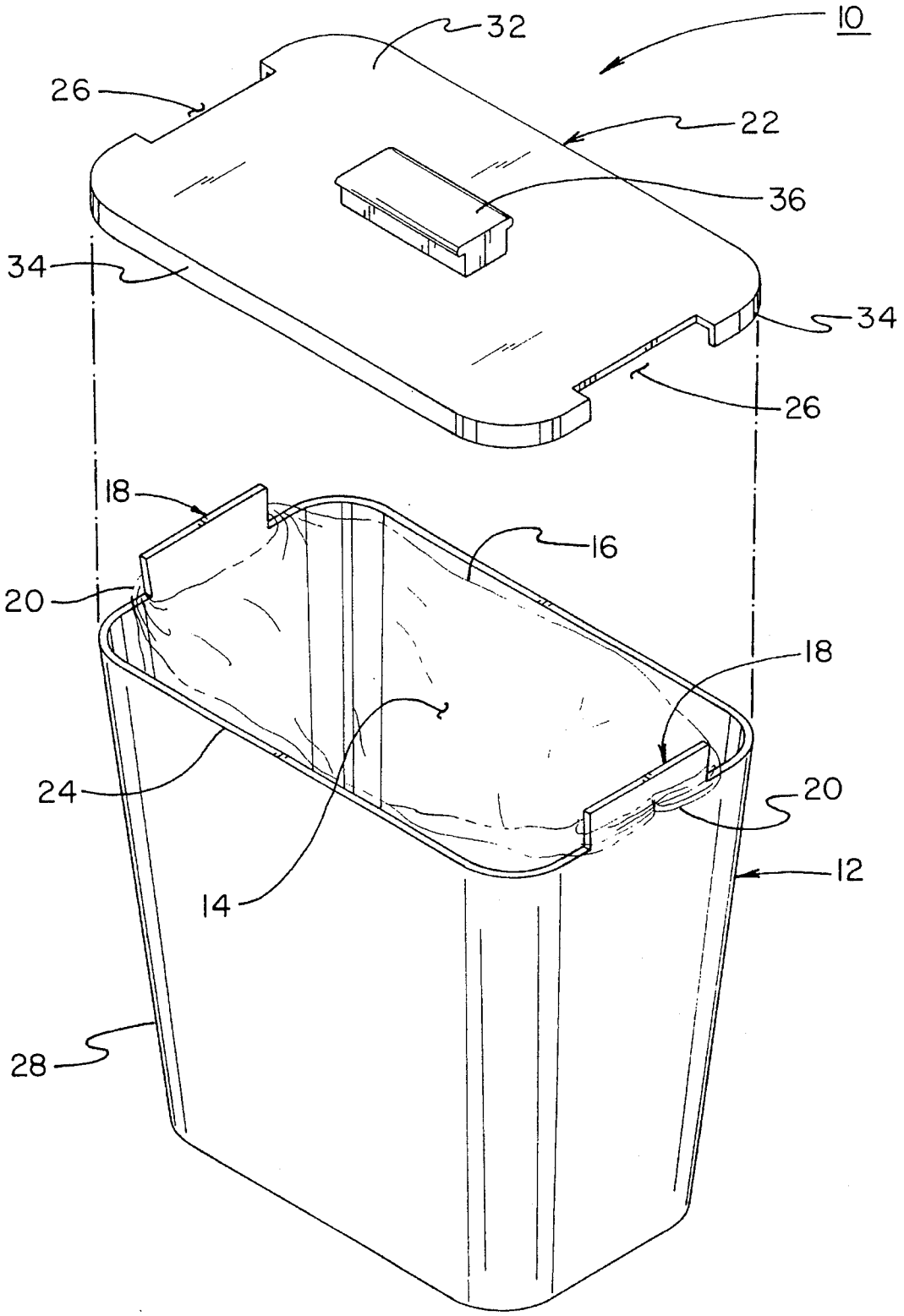
FIG. 1 is an isometric illustration of a grocery bag holding container according to the present invention.

With reference now to the drawings, and in particular to FIGS. 1–6 thereof, a new grocery bag holding container embodying the principles and concepts of the present invention and generally designated by the reference numeral 10 will be described.

More specifically, it will be noted that the grocery bag holding container 10 comprises a container means 12 having an interior 14 for receiving a bag 16, as shown in FIG. 1 of the drawings. An engaging means 18 projects from laterally opposed sides of the container means 12 for engaging opposed handle loops 20 of the bag 16. A lid 22 is positionable across an open upper end 24 of the container means 12 and includes laterally opposed cut-outs 26 directed thereinto permitting projection of the engaging means 18 through the lid 22. By this structure, the opposed handle loops 20 of a bag 16 can be engaged to the engaging means 18 so as to support the bag within the interior 14 of the container means 12 for depositing of refuse or other materials into the bag.

Figure 2:
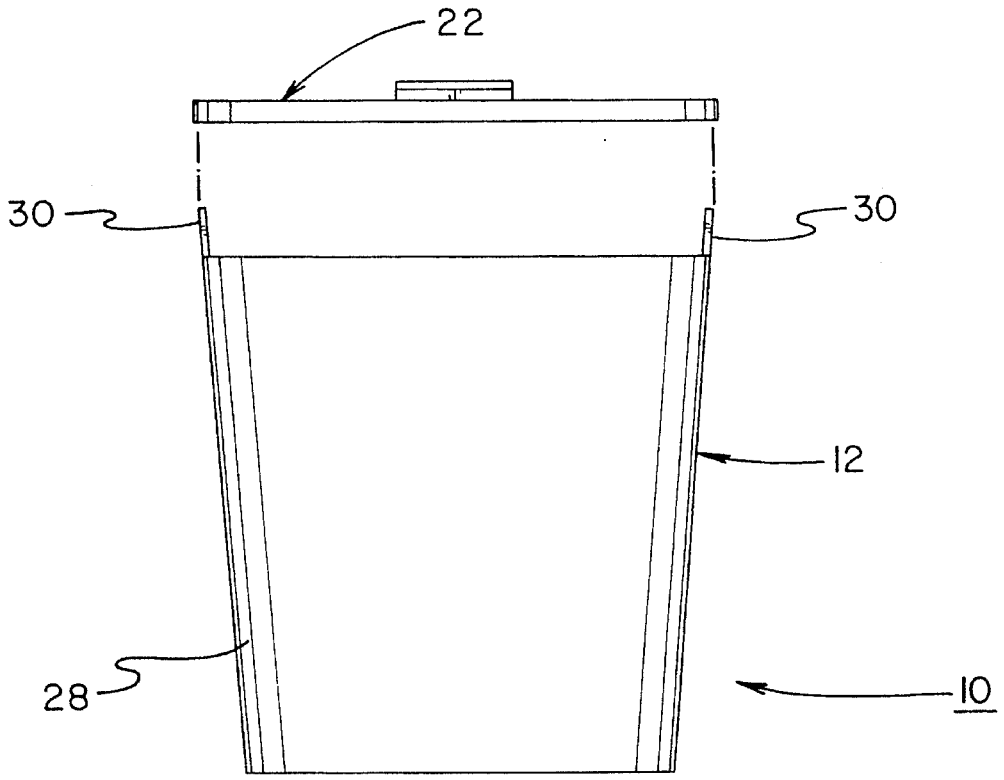
FIG. 2 is an exploded front elevation view of the invention.
Figure 3:
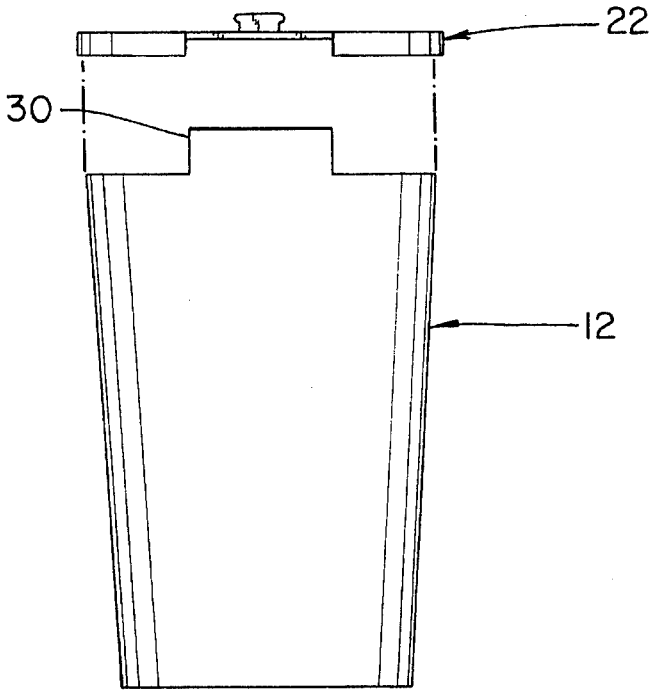
FIG. 3 is an exploded side elevation view thereof.

As best illustrated in FIGS. 1 through 3, it can be shown that the container means 12 according to the present invention 10 preferably comprises a substantially rectangular cross section container 28 having an open upper end 24 permitting access to an interior 14 of the container. Although the container 28 is preferably rectangular in cross section, it is within the intent and purview of the present invention to include containers of circular, ovoid, or other conventionally known cross sectional shapes.

Figure 5:
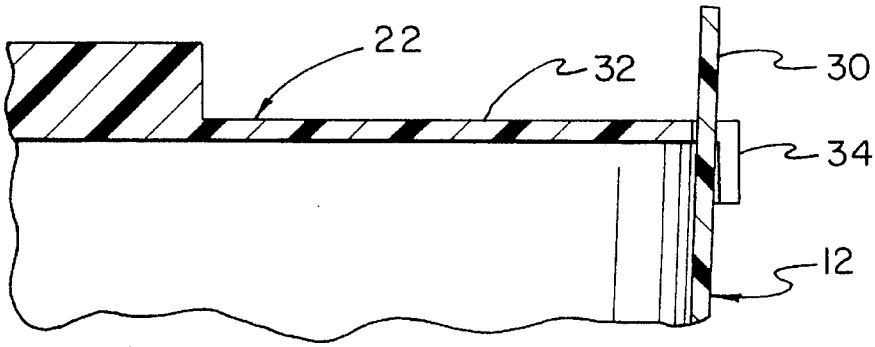
FIG. 5 is a cross sectional view taken along line 5—5 of FIG. 4.

With continuing reference to FIGS. 1 through 3 and as shown in FIG. 5, the engaging means 18 according to the present invention 10 preferably comprises a pair of side wall projections 30 projecting from laterally opposed side walls of the container 18. Each of the side wall projections 30 is preferably integrally molded with the side wall of the container 28 and is shaped so as to define an elongated planar panel projecting upwardly from the open upper end 24 of the container 28. The elongated planar panel shape of the side wall projections 30 operates to extend the opposed handle loops 20 of the bag 16 so as to maintain the bag in an open configuration. It is important to note that the side wall projections 30 are fixedly secured by the integral construction thereof relative to the side wall of the container 28. Such fixed securement of the side wall projections 30 to the container 28 precludes an unintentional disengagement of the opposed handle loops 20 from the engaging means 18.

Figure 4:
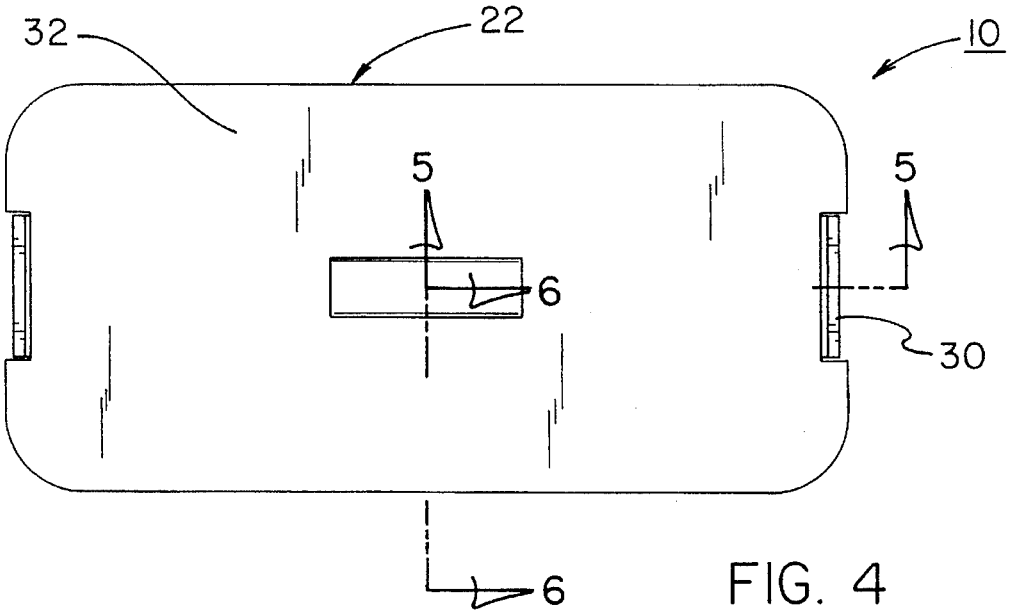
FIG. 4 is a top plan of the invention.
Figure 6:
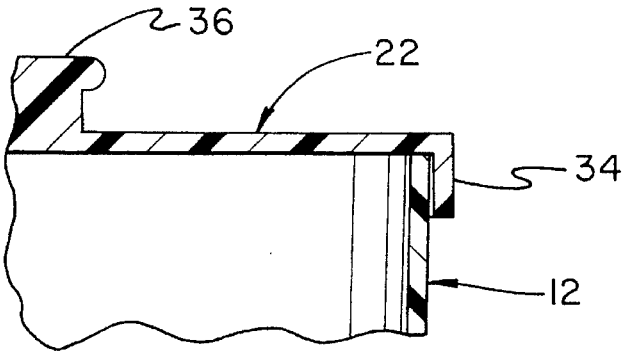
FIG. 6 is a cross sectional view taken along line 6—6 of FIG. 4.

Referring now to FIGS. 4 through 6 with concurrent reference to FIG. 1, it can be shown that the lid 22 according to the present invention 10 preferably comprises a substantially rectangular lid panel 32 having a depending side wall 34 extending from an outer periphery of the lid panel. The lid 22, as described above, is shaped so as to define a pair of laterally opposed cut-outs 26 directed through the depending side wall 34 and into the lid panel 32. The lateral cut-outs 26 operate to permit projection of the side wall projections 30 passed the lid panel 32 when the lid 22 is positioned over the open upper end 24 of the container 28. By this structure, unintentional removal of the opposed handle loops 20 from the engaging means 18 while the lid 22 is positioned over the open upper end 24 is further reduced. To facilitate manual manipulation of the lid 22, a handle 36 extends therefrom for being grasped and manipulated by an individual during use of the device 10.

In use, the grocery bag holding container 10 according to the present invention can be easily utilized to support a grocery bag 16 having opposed handle loops 20 in an open configuration such that items can be deposited therewithin in an easy and efficient manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A grocery bag holding container comprising:

a container means having an interior for receiving a bag having handle loops, said container means comprising a substantially rectangular cross section container having an open upper end permitting access to an interior of the container;

an engaging means projecting from laterally opposed sides of the container means for engaging opposed handle loops of a bag, said engaging means comprising a pair of side wall projections extending from laterally opposed side walls of the container, each of the side wall projections being shaped so as to define an elongated planar panel projecting upwardly from the open upper end of the container; and a lid positionable across said open upper end of the container means, said lid including laterally opposed cut-outs directed thereinto permitting projection of the engaging means through the lid, said lid comprising a substantially rectangular lid panel having a depending side wall extending downwardly from an outer periphery of the lid panel, said laterally opposed cut-outs being directed through the depending side wall and into the lid panel.

2. The grocery bag holding container of claim 1 wherein the lid further comprises a handle extending from the lid panel.

* * * * *